United States Patent [19]

Russell et al.

[11] 4,263,768

[45] Apr. 28, 1981

[54] POUCH CARRIER

[75] Inventors: Robert C. Russell; Richard W. Entler, both of Columbus, Ohio

[73] Assignee: Rexham Corporation, New York, N.Y.

[21] Appl. No.: 119,221

[22] Filed: Feb. 7, 1980

[51] Int. Cl.[3] ..... B65B 43/30

[52] U.S. Cl. ..... 53/384; 198/653

[58] Field of Search ..... 198/479, 653, 694, 695, 198/696; 53/384, 570

[56] References Cited

U.S. PATENT DOCUMENTS

| | | | |
|---|---|---|---|
| 3,269,524 | 8/1966 | Canfield | 198/695 |
| 3,568,402 | 3/1971 | Lense et al. | 53/384 |
| 4,108,300 | 8/1978 | Wayase et al. | 53/384 X |

*Primary Examiner*—Jeffrey V. Nase

*Attorney, Agent, or Firm*—Leydig, Voit, Osann, Mayer & Holt, Ltd.

[57] ABSTRACT

Pouches are advanced broadwise by carriers each having two laterally spaced clamps for gripping the side margins of the pouch. The clamps are supported by pivoted linkages which enable the clamps to be moved laterally toward and away from one another for the purpose of opening and closing the mouth of the pouch as the pouch is advanced through the filling and top sealing stations of a packaging machine.

5 Claims, 7 Drawing Figures

POUCH CARRIER

BACKGROUND OF THE INVENTION

This invention relates to a carrier for holding an envelope-type pouch and for advancing the pouch through the various stations of a packaging machine. Devices for holding and advancing pouches are disclosed in Canfield U.S. Pat. No. 3,269,524 and in Lense et al U.S. Pat. No. 3,568,402. In the disclosures of these patents, the pouch is advanced in an edgewise direction and is gripped at its leading and trailing edges by two separate clamping devices which are carried on a chain. One of the clamping devices is adapted to be shifted along the chain and toward and away from the other clamping device in order to first open the top of the pouch preparatory to the pouch being filled with product and then to close the top of the pouch preparatory to the top being sealed.

SUMMARY OF THE INVENTION

The general aim of the present invention is to provide a new and improved carrier which is adapted to advance a pouch in a broadwise direction, which includes laterally shiftable clamps operable to open and close the pouch, which keeps the clamps properly positioned relative to the pouch with a unique self-centering action and which is relatively trouble-free and not likely to become fouled by product during the packaging operation.

A more detailed object is to provide a carrier in which two laterally spaced clamps are supported for lateral shifting effected for the most part through the use of pivotal linkages which may continue to operate effectively even when coated with liquid food product or the like. The linkages are further characterized by their ability to keep the two clamps of the carrier centered with respect to the drive chain in all lateral positions of the clamps.

The invention also resides in the ability of the carriers to be easily adjusted to handle pouches of different widths.

These and other objects and advantages of the invention will become more apparent from the following detailed description when taken in conjunction with the accompanying drawings.

DETAILED DESCRIPTION OF THE PREFERRED EMBODIMENT

Figure 3:
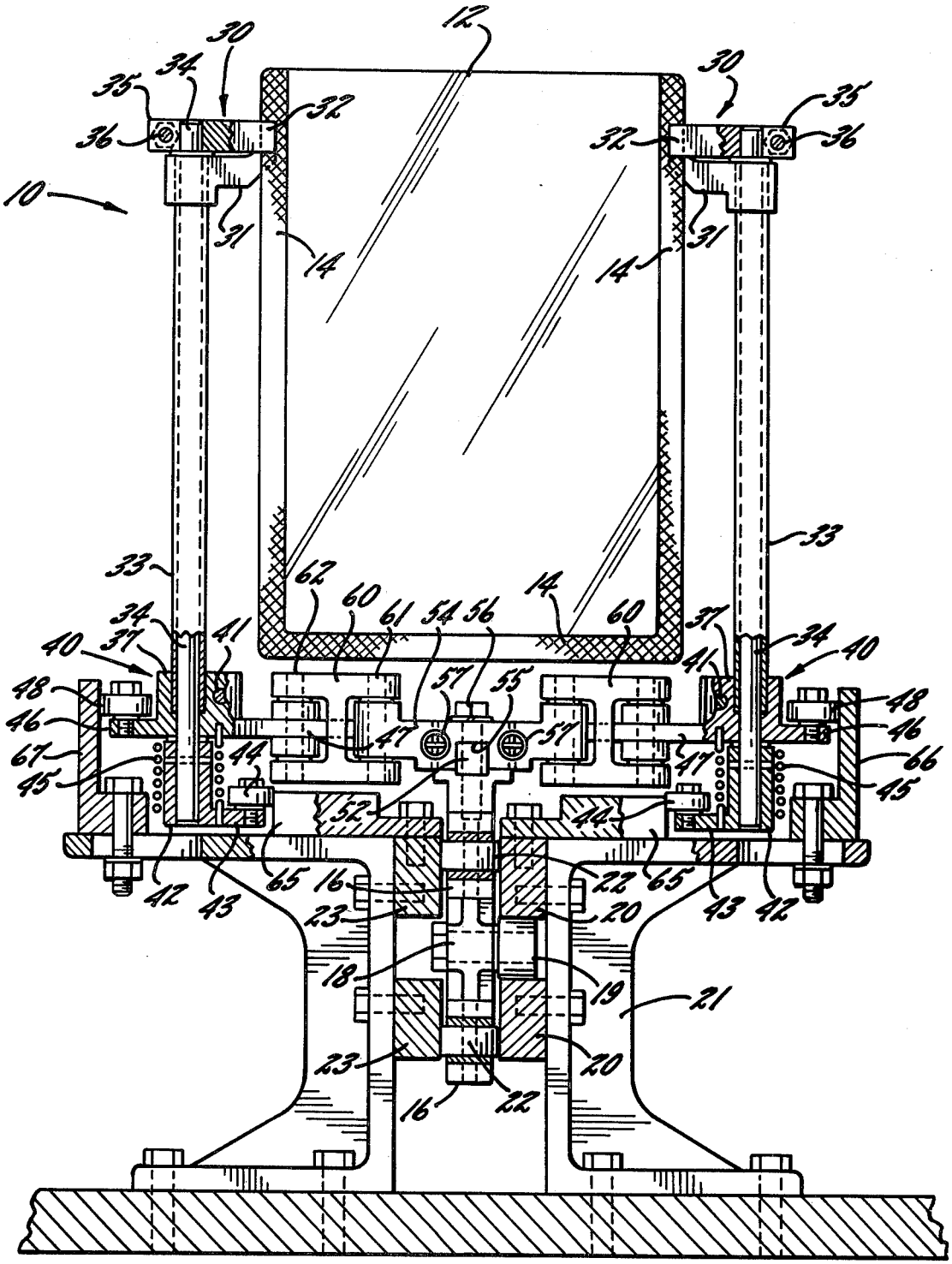
FIG. 3 is an enlarged fragmentary cross-section taken substantially along the line 3—3 of FIG. 1.

As shown in the drawings for purposes of illustration, the invention is embodied in carriers 10 which form part of a packaging machine 11 and which are adapted to hold and advance substantially flat, envelope-type pouches 12. Each pouch is formed by two opposing upright side panels made of flexible heat-sealable material and joined along their side and bottom margins by heat seals 14 (FIG. 3).

Certain details of the packaging machine 11 are disclosed in Russell et al U.S. application Ser. No. 119,366, filed Feb. 7, 1980, entitled Packaging Machine With Pouch Transfer And Opening Mechanism and assigned to the assignee of the present invention. Briefly, upright pouches 12 are advanced edgewise from the pouch making section of the machine by the transfer mechanism and, during the advance, are gradually turned through ninety degrees and into a position to move broadwise through the pouch filling section of the machine. As each pouch approaches its broadwise position, it is picked up and gripped by one of the carriers 10. The carrier first advances the pouch through one or more filling stations where liquid and/or solid food product is deposited into the pouch. Thereafter, the carrier advances the pouch through a sealing station where the top of the pouch is closed and sealed.

The carriers 10 are secured to and are advanced by a pair of vertically spaced roller chains 16 which are trained around a pair of vertically spaced sprockets 17. The sprockets are rotated continuously about an upright axis and thus the carriers 10 and the pouches 12 are advanced with continuous motion as opposed to intermittent or start-stop motion.

Figure 2:
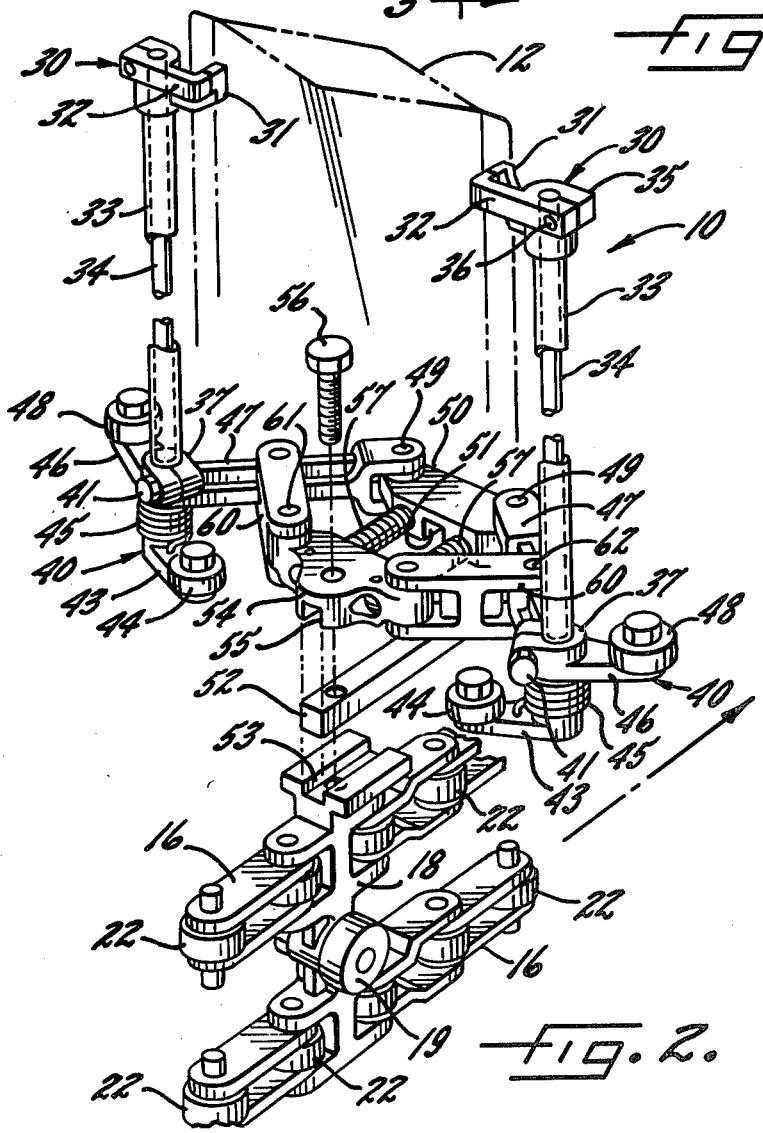
FIG. 2 is an exploded perspective view of one of the carriers.

As shown in FIG. 2, each carrier 10 is attached to the chains 16 by a bracket 18 which extends vertically between the two chains and connects the chains together. A roller 19 extends laterally from one side of each bracket and is journaled on the bracket to turn about a horizontal axis. The roller is adapted to ride in a track defined between two vertically spaced rails 20 (FIG. 3) which are secured to the main frame 21 of the machine 11. Engagement of the roller with the lower rail prevents the chains from sagging. The chains are supported laterally by virtue of the rollers 22 of the chains engaging the sides of the rails 20 and the sides of an opposing pair of rails 23 (FIG. 3) which also are secured to the frame 21.

Figure 1:
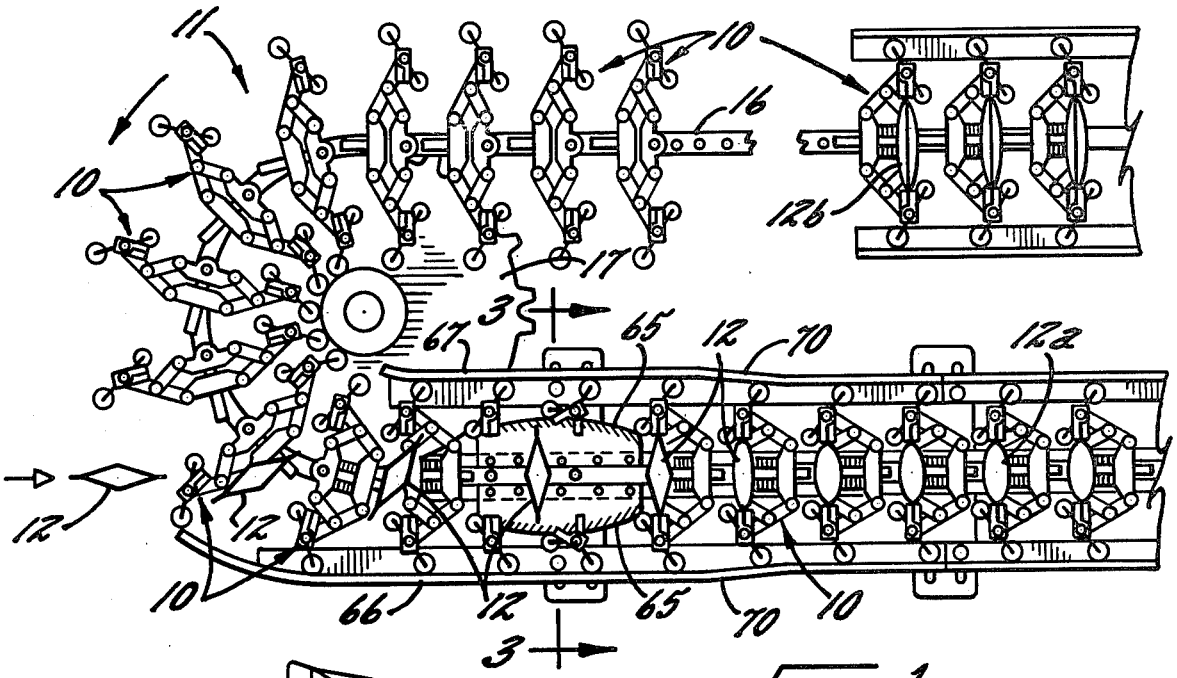
FIG. 1 is a fragmentary top plan view of a packaging machine equipped with new and improved carriers embodying the unique features of the present invention.
Figures 4, 5, 6, 7:
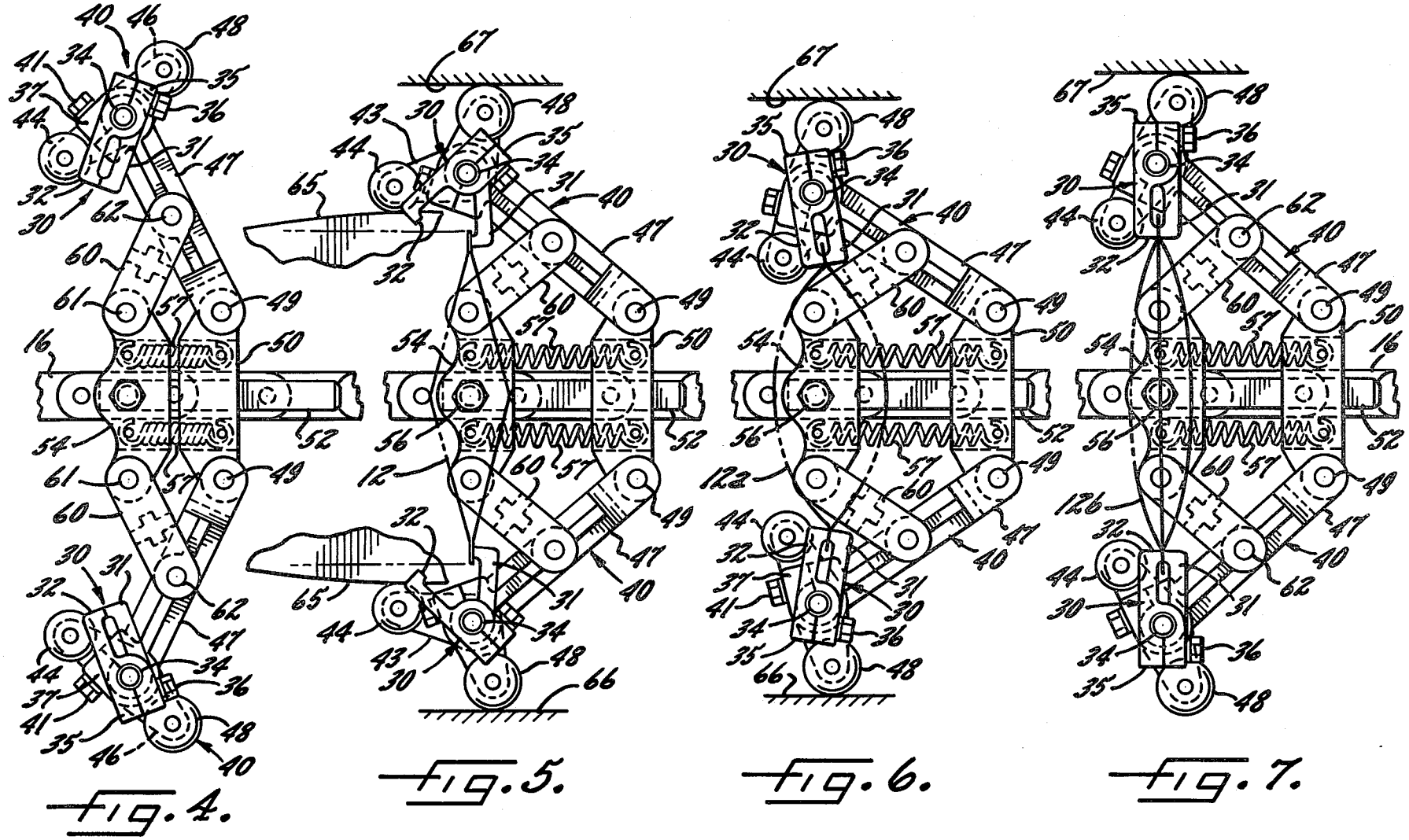
FIG. 4 is a top plan view of one of the carriers.
FIGS. 5, 6 and 7 are views similar to FIG. 4 but show successively moved positions of certain parts of the carrier.

As each pouch 12 is advanced by its carrier 10, the side margins of the pouch are shifted toward one another to cause the side panels to expand and thereby open the mouth of the pouch widely preparatory to the pouch being filled with product (see the pouch 12*a* in FIGS. 1 and 6). After the pouch has been filled, the side margins of the pouch are pulled away from one another to flatten and close the top of the pouch preparatory to the top being sealed (see the pouch 12*b* in FIGS. 1 and 7).

The present invention contemplates the provision of a unique carrier 10 which is adapted to open and close the pouch 12 as the pouch is moved broadwise and which is characterized by the fact that the opening and closing action is produced primarily by self-centering pivotal linkages that are not likely to become fouled by product. Moreover, the carrier can be easily adjusted to handle pouches of different widths within a relatively wide range of widths.

More specifically, each carrier 10 comprises a pair of clamps 30 spaced laterally from opposite sides of the chains 16 and adapted to grip opposite side margins of the pouch 12 adjacent the upper end of the pouch. Each clamp comprises a fixed jaw 31 and further comprises a movable jaw 32 which is adapted to swing between closed and open positions relative to the fixed jaw in order to grip and release the pouch.

As shown in FIG. 3, the fixed jaw 31 of each clamp 30 is secured rigidly to the upper end portion of an upright sleeve 33. The movable jaw 32 is positioned above the fixed jaw and is fastened to the upper end of an upright rod 34 which extends through the sleeve. The movable jaw includes a split collar 35 which is clamped to the rod by a screw 36. By loosening the screw, the angular position of the movable jaw on the rod may be changed.

The lower end portion of each sleeve 33 is received within a split collar 37 (FIGS. 2 and 3) which defines the midportion of a crank 40. The split collar 37 is adapted to be clamped tightly to the sleeve 33 by a screw 41. When the screw 41 is loosened, the sleeve 33 may be turned in the collar 37 and thus the angular position of the fixed jaw 31 may be adjusted.

Each rod 34 is rotatably journaled by the collar 37 and projects downwardly beyond the collar (see FIG. 3). Keyed to the lower end portion of each rod 34 is a sleeve 42 whose lower end is formed with a laterally projecting arm 43 which extends generally inwardly. A roller follower 44 is journaled on the free end of the arm 43 and, together with the rod 34 forms an operator for opening and closing the movable jaw 32. When the follower is cammed outwardly, it causes the rod 34 to turn in a clockwise direction to move the movable jaw from its closed position shown in FIG. 4 to its open position shown in FIG. 5. Upon inward movement of the follower, a torsion spring 45 (FIG. 3) turns the rod counterclockwise to close the movable jaw. The spring 45 is telescoped over the sleeve 42 and its ends are anchored to the sleeve and to the collar 37.

The two clamps 30 of each carrier 10 are adapted to be shifted toward one another to open the mouth of the pouch 12 and are adapted to be shifted away from one another in order to stretch and close the top of the pouch. For this purpose and in carrying out the invention, each crank 40 is formed with two angularly related arms 46 and 47. The arm 46 is formed integrally with the collar 37 of the crank 40 and extends generally outwardly from the collar. A roller follower 48 is journaled on the free end of the arm 46 and is rotatable about an upright axis.

As shown in FIGS. 2 and 3, the arm 47 of each crank 40 extends generally inwardly from the collar 37 and also is formed integrally with the collar. The inner ends of the two arms 47 are bifurcated and are connected by vertical pivots 49 to the ends of a slide 50. A square-cornered groove 51 (FIG. 2) is formed in the lower side of the slide and slidably receives a square bar 52 which, in turn, is received in a groove 53 formed in the upper side of the bracket 18. Also overlying the bar 52 is a fixed member or block 54 whose lower side is formed with a groove 55 for receiving the bar. A screw 56 extends through the block 54 and the bar 52 and is threaded into the bracket 18 so as to rigidly clamp the block and the bar to the bracket. Both the slide 50 and the block 54 are centered relative to the upper chain 16. The slide 50 is adapted to move along the bar and thus may move longitudinally of the chains and toward and away from the fixed block 54. Two tension springs 57 are connected between the slide and the block and urge the slide toward the block to the position shown in FIG. 4.

Each carrier 10 is completed by a pair of links 60 having bifurcated ends. One end of each link is connected to the block 54 by a vertical pivot 61 (FIG. 4). A second vertical pivot 62 connects the opposite end of each link to the arm 47 of the crank 40 at a point about midway along the length of the arm.

The packaging machine 11 includes a pair of cams 65 (FIGS. 1 and 5) which coact with the two followers 44 of each carrier 10 to effect opening and closing of the movable jaws 32 of the carrier. As shown in FIGS. 3 and 5, the two cams are located inwardly of the followers 44 and are fixed to the frame 21. Each cam has a convexly curved profile which is engaged by the follower as the carrier is advanced through a relatively short distance by the chains 16.

In addition, the machine 11 includes another pair of cams 66 and 67 (FIGS. 1 and 3) which coact with the followers 48 of each carrier 10 to effect inward and outward shifting of the clamps 30. The cams 66 and 67 are in the form of laterally spaced rails which are located outboard of the followers 48, the cam rails being fixed to the frame 21. There are no cam rails near the upstream end of the machine 11 along the rear side thereof and, in some areas (e.g., the top seal area) along the machine, the outermost rail 66 may be interrupted and thus only the innermost rail 67 extends through such areas (see FIG. 7).

Operation

As each carrier 10 curves around the sprockets 17, the carrier is positioned as shown in FIG. 4 and, at this time, the followers 48 of the carrier are free of the cam rails 66 and 67. The springs 57 urge the slide 50 nearly into engagement with the block 54. The slide acts through the cranks 40 and causes the two clamps 30 of the carrier to be spread apart by a substantial distance. The links 60 hold the clamps in the angular orientation shown in FIG. 4, each clamp being inclined at a slight angle to the chains 16 and pointing in an upstream direction. Each movable jaw 32 is held closed by the torsion spring 45.

When each carrier 10 leaves the sprockets 17, it enters between the cam rails 66 and 67. At this time, the pouch 12 is being turned from its edgewise position to its broadwise position by the transfer mechanism disclosed in the aforementioned application. The transfer mechanism holds the pouch in a partially open position.

As each carrier 10 enters between the cam rails 66 and 67, the rails cam the followers 48 inwardly. The followers 48 act through the cranks 40 to shift the slide 50 forwardly relative to the block 54 (see FIG. 5). At the same time, the cranks swing about the pivots 49 to cause the clamps 30 to move inwardly to positions in which the lateral spacing between the clamps is somewhat less than the width of the pouch 12. The links 60 cause the clamps to turn to a position in which the fixed jaws 31 of the clamps are nearly perpendicular to the chains (see FIG. 5).

Just shortly before the transfer mechanism turns the pouch 12 to its broadwise position, the cam followers 44 encounter and are cammed outwardly by the inside cams 65. As a result, the movable jaw 32 of each clamp 30 is opened (see FIG. 5) so that the pouch may move into the clamp. Thereafter, the cam followers 44 ride inwardly along the inside cams 65. This allows the torsion springs 45 to close the movable jaws 32 and, as a result, the pouch is gripped by the clamps. The transfer mechanism then releases the pouch to the control of the carrier 10.

After the clamps 30 close, the cam followers 48 of each carrier 10 encounter narrowing transistions 70 (FIG. 1) in the cam rails 66 and 67. As a result, the cam followers 48 are cammed inwardly, the slide 50 moves farther away from the block 54, and the cranks 40 swing about the pivots 49 to shift the clamps 30 toward one another (see FIG. 6). Such shifting causes the mouth of the pouch 12 to bow to a widely open position to facilitate filling of the pouch. The links 60 cause the clamps to assume the angular orientation shown in FIG. 6, the clamps being inclined slightly relative to the chains 16 and pointing in a downstream direction.

As the carrier 10 approaches the top sealing area, the innermost cam rail 67 undertakes a widening transistion to allow the adjacent cam follower 48 to move away from the chains 16. The tension springs 57 pull the slide 50 toward the block 54 and cause the cranks 40 to swing outwardly. Accordingly, the clamps 30 are shifted outwardly and stretch and close the top of the pouch 12 (see FIG. 7) preparatory to the top being sealed. The links 60 cause the clamps to turn to positions in which the clamps are perpendicular to the chains 16. Thus, the clamps cause the top of the pouch to assume a nearly perfect straight line configuration so that a good heat seal can be formed.

After the top of each pouch 12 has been sealed, the cam followers 44 are actuated by inside cams (not shown) to open the clamps 30. The pouch then is removed from the clamps.

The carriers 10 are characterized by the fact that the inward and outward movement of the clamps 30 is produced, for the most part, by the pivotally mounted cranks 40 and links 60. The pivots 49, 61 and 62 are not as likely to be fouled by food product as would be the case if laterally extending slides were used to mount the clamps 30 for inward and outward movement. While the carrier 10 does employ the slide 50, this single slide is located at the center of the carrier and moves longitudinally of the chains 16 rather than laterally. The bar 52 and the groove 51 in the slide can, therefore, be protected by a cover if fouling should become a problem.

The cranks 40, the slide 50 and the links 60 coact with the springs 57 to make the clamps 30 self-centering. That is to say, the two clamps will always be spaced equidistantly from the chains 16 even if one of the cam rails 66 or 67 should happen to be spaced a slightly different distance from the chain than the other rail. Indeed, only one rail 67 is used when the clamps are shifted outwardly to close the top of the pouch 12. The self-centering action of the carrier causes each clamp to follow the movement of the other and thus the clamps are positioned equidistantly from the chains even when only one cam rail is used.

The carrier 10 can be adjusted to handle pouches ranging in width from 4-½ inches to 7 inches, it being necessary to adjust the spacing between the cam rails 66 and 67 when the width of the pouch is changed. When the carrier is changed over to handle a pouch of a different width, the angular position of the movable jaw 32 on the rod 34 is adjusted by loosening the screw 36 while the angular position of the fixed jaw 31 is adjusted by loosening the screw 41 and turning the sleeve 33. The two jaws then are fixed so as to extend perpendicular to the chains 16 when the pouch is stretched and closed as shown in FIG. 7.

We claim:

1. A carrier adapted for attachment to a power-driven chain, adapted to hold an envelope-type pouch in an upright position and adapted to move the pouch broadwise when the chain is advanced, said carrier comprising a pair of clamps spaced laterally from opposite sides of the chain and adapted to grip opposite side margins of the pouch, each of said clamps comprising a pair of jaws with at least one jaw of each clamp being movable between closed and open positions with respect to the other jaw of the clamp, an operator associated with said one jaw of each clamp and operable when actuated to move such jaw between its closed and open positions, a pair of uprights spaced laterally from opposite sides of the chain, each of said clamps being supported on one of said uprights, means enabling said clamps to move toward one another to open the pouch and away from one another to close the pouch, said means comprising a member secured to said chain and held against movement along the chain, a slide positioned longitudinally along said chain from said member and guided for longitudinal movement toward and away from said member, means resiliently urging said slide to move longitudinally relative to said member, a pair of arms, each of said arms having one of its ends connected to one of said uprights and having its other end connected pivotally to said slide, and a pair of links, each of said links having one end connected pivotally to said member and having its other end connected pivotally to one of said arms between the ends of the arm.

2. A carrier adapted for attachment to a power-driven chain, adapted to hold an envelope-type pouch in an upright position and adapted to move the pouch broadwise when the chain is advanced, said carrier comprising a pair of clamps spaced laterally from opposite sides of the chain and adapted to grip opposite side margins of the pouch, each of said clamps comprising a pair of jaws with at least one jaw of each clamp being movable between closed and open positions with respect to the other jaw of the clamp, an operator associated with said one jaw of each clamp and operable when actuated to move such jaw between its closed and open positions, a pair of uprights spaced laterally from opposite sides of the chain, each of said clamps being supported on the upper end portion of one of said uprights, means enabling said clamps to move toward one another to open the pouch and away from one another to close the pouch, said means comprising a member secured to said chain and held against movement along the chain, a slide positioned longitudinally along said chain from said member and guided for movement toward and away from said member, a pair of cranks each having an intermediate portion and having first and second angularly related arms rigid with and projecting from said intermediate portion, the intermediate portion of each of said cranks being secured rigidly to the lower end portion of one of said uprights, the first arm of each crank having its distal end connected pivotally to said slide, a pair of links, each of said links having one end connected pivotally to said member and having its other end connected pivotally to the first arm of one of said cranks between the ends of the first arm, means on the distal end of the second arm of each crank and operable when moved toward said chain to shift said slide away from said member, and means resiliently urging said slide toward said member.

3. A carrier as defined in claim 2 in which each of said uprights comprises a sleeve, and said operator including a rod which extends rotatably through said sleeve, said one jaw being fastened to said rod, said other jaw being fastened to said sleeve, and said rod being operable when actuated to turn within said sleeve to move said one jaw between its closed and open positions.

4. A carrier as defined in claim 3 in which the intermediate portion of each of said cranks is secured rigidly to one of said sleeves.

5. A carrier as defined in claim 4 further including means permitting selective adjustment of the angular position of said one jaw on said rod, and means permitting selective adjustment of the angular position of said sleeve relative to the intermediate portion of the associated crank.

* * * * *